US005950860A

United States Patent [19]

Kesterman et al.

[11] Patent Number: 5,950,860

[45] Date of Patent: Sep. 14, 1999

[54] ADJUSTABLE LENGTH STORAGE TANK SUMPS

[75] Inventors: James Kesterman, Cincinnati; Peter E. Manger, West Chester, both of Ohio

[73] Assignee: Dover Corp., New York, N.Y.

[21] Appl. No.: 08/729,782

[22] Filed: Oct. 8, 1996

[51] Int. Cl.[6] ..... B65D 6/00

[52] U.S. Cl. ..... 220/324; 220/4.26; 220/669

[58] Field of Search ..... 220/324, 325, 220/4.01, 4.12, 4.26, 320, 4.03, 669, 565

[56] References Cited

U.S. PATENT DOCUMENTS

| | | | |
|---|---|---|---|
| D. 309,308 | 7/1990 | Webb . | |
| D. 313,418 | 1/1991 | Webb . | |
| D. 322,970 | 1/1992 | Webb . | |
| 333,105 | 12/1885 | Bremaker et al. | 220/4.26 X |
| 537,182 | 4/1895 | Brown | 220/4.26 X |
| 1,492,605 | 5/1924 | Rice | 220/669 X |
| 2,069,088 | 1/1937 | Geske et al. | 220/324 X |
| 3,754,674 | 8/1973 | Wesoloski | 220/325 X |
| 3,858,752 | 1/1975 | Marvin, Jr. et al. | 220/325 |
| 4,457,349 | 7/1984 | Vazin . | |
| 4,715,513 | 12/1987 | Shelton, Jr. | 220/669 X |
| 4,793,387 | 12/1988 | LeBlanc et al. . | |
| 4,805,444 | 2/1989 | Webb . | |
| 4,932,257 | 6/1990 | Webb . | |
| 4,971,477 | 11/1990 | Webb et al. . | |
| 5,040,408 | 8/1991 | Webb . | |
| 5,058,633 | 10/1991 | Sharp . | |
| 5,060,509 | 10/1991 | Webb . | |
| 5,076,456 | 12/1991 | Geyer . | |
| 5,098,221 | 3/1992 | Osborne . | |
| 5,160,064 | 11/1992 | LeBlanc . | |
| 5,201,151 | 4/1993 | LeBlanc et al. . | |
| 5,257,652 | 11/1993 | Lawrence . | |
| 5,263,794 | 11/1993 | Webb . | |
| 5,271,518 | 12/1993 | Webb . | |
| 5,297,896 | 3/1994 | Webb . | |
| 5,301,853 | 4/1994 | Addison et al. | 220/320 |
| 5,333,490 | 8/1994 | Webb . | |
| 5,346,625 | 9/1994 | Webb . | |

(List continued on next page.)

FOREIGN PATENT DOCUMENTS 9320372 10/1993 WIPO .

OTHER PUBLICATIONS

Tank Sump Instructions, Lid Kit Installation, Publication No. TS1132, Mar. 22, 1996.

Advanced Polymer Technology, Inc., Quick–Set™ Modular Tank Sump System, Pub. TS201, various pp. 8–01–93, Elkhart, IN.

Environ, Tank Sump Manual, Publication PM–0104, Issue Date Jul. 1, 1994, various pages Environ Products, Inc.. Lionville, PA.

Total Containment Inc., Dispenser Sumps, Publ No. DS800, Sep. 1, 1994, various pages, Oaks, PA.

(List continued on next page.)

*Primary Examiner*—Steven Pollard

*Attorney, Agent, or Firm*—Dinsmore & Shohl LLP

[57] ABSTRACT

An adjustable length storage tank sump for attachment to an underground storage tank is provided. The storage tank sump is formed from a body having a polygonal lower portion with a chamber, an interconnecting conical middle portion, and an upper portion having a plurality of formations and an opening disposed thereon. The formations are axially spaced along the longitudinal axis of the body so that a predetermined number of the formations can be selectively removed during installation, thereby reducing the length of the storage tank sump. A sealing surface is provided on each formation so that a single seal can be installed on the formation closest the opening. An attachment structure, which is interchangeable among the formations, removably engages the formation closest to the opening. A removable lid for covering the opening is provided, the lid engaging the attachment structure such that the lid sealingly contacts the seal.

22 Claims, 5 Drawing Sheets

U.S. PATENT DOCUMENTS

| | | | |
|---|---|---|---|
| 5,361,930 | 11/1994 | Perry | 220/4.12 X |
| 5,366,318 | 11/1994 | Brancher . | |
| 5,372,454 | 12/1994 | Lawrence . | |
| 5,398,976 | 3/1995 | Webb . | |
| 5,407,300 | 4/1995 | Guindon et al. . | |
| 5,423,447 | 6/1995 | Youngs . | |
| 5,490,419 | 2/1996 | Webb . | |
| 5,494,374 | 2/1996 | Youngs et al. . | |
| 5,527,130 | 6/1996 | Webb . | |
| 5,553,971 | 9/1996 | Osborne . | |
| 5,567,083 | 10/1996 | Osborne . | |
| B1 5,040,408 | 4/1994 | Webb . | |
| B1 5,060,509 | 9/1994 | Webb . | |
| B1 5,263,794 | 1/1996 | Webb . | |

OTHER PUBLICATIONS

Environ, GeoFlex™ Piping System, Pub. PM–0402, Feb. 1, 1994, various pages, Environ Products, Inc., Lionsville, PA.

Total Containment Inc., US Price Manual, Pub. PM1500, Apr. 1, 1995, various pages, Oaks, PA.

Total Containment, Inc. Tank Sumps: Fiberglass/Cuffed Polyethylene, Pub. SR300, Jun. 1, 1995, various pages, Oaks, PA.

Advanced Polymer Technology, Inc., Poly–Tech TS–4230 Standard Burial Tank Sump, Pub. TS42, Sep. 15, 1995, various pages, Elkhart, IN.

Advanced Polymer Technology, Inc., Poly–Tech, Advanced Flexible Underground Piping System, Form 4–95–5M, 1995, various pages, Elkhart, IN.

Total Containment, Inc., Delivering the Difference, 1996, various pages, Oaks, PA.

Advanced Polymer Technology, Inc., Poly–Tech WC–4236 Watertight Design Lid Kit, Pub. WC–4236, Feb. 1, 1996, various pages, Elkhart, IN.

Advanced Polymer Technology, Inc., Poly–Tech Large Mouth Modular Dispenser Sump, Pub. LM201, Apr. 1, 1996, various pages, Elkhart, IN.

Total Containment Inc., Pioneering Secondary Containment Systems for Future Generations, PB100, 4.95, various pages, Oaks, PA.

Environ Products Inc., Product Price List, Pub. P–APB–1010, Aug. 15, 1996, Lionville, PA.

Environ Products, Inc., The GeoFlex System, Pub., P–APB–2010, Oct. 01, 1996, various pages, Lionville, PA.

International Search Report dated May 8, 1998 in PCT/US97/15748.

ADJUSTABLE LENGTH STORAGE TANK SUMPS

TECHNICAL FIELD OF THE INVENTION

This invention relates generally to the field of storage tank sumps suitable for use with underground storage tanks, and, more particularly, to adjustable length storage tank sumps.

BACKGROUND OF THE INVENTION

Storage tank sumps are used in the art to house or otherwise enclose various type of fluid transfer components (e.g., pumps, filters and the like) which are used to transfer liquids from an underground storage tank to above ground dispensers. In addition, storage tanks sumps are typically liquid tight, thereby reducing the risk of ground water pollution from liquid product spillage (e.g., gasoline and other petroleum distillates) which can occur when an underground storage tank holding the same is filled or the fluid transfer components housed with the storage tank sump are serviced or replaced. Typically, the underground storage tanks are placed on a pallet or concrete pad poured at the bottom of an excavated hole. Following attachment of the storage tank sump to the storage tank, the excavated hole is then back-filled and a driveway slab is poured over the top of the excavated hole.

While the fixed length storage tank sumps available in the art have been suitable for the purposes for which they were designed, heretofore there has not been available an adjustable length storage tank sump of simple construction having multiple sealing surfaces for accommodating a single easily replaceable seal. Further, heretofore there has not been available an adjustable length storage tank sump providing a structure for simply and quickly sealingly attaching a lid to the sump, wherein the structure attaching the lid is disposed outside of the sump sealing surfaces.

SUMMARY OF THE INVENTION

It is an object of the present invention to obviate the above-described problems and shortcomings in the storage tank sumps heretofore available in the industry.

It is another object of the present invention to provide a storage tank sump whose length can be quickly and easily adjusted at the storage tank installation site.

It is yet another object of the present invention to provide a storage tank sump having a simple single seal which is easily replaceable and which can accommodate the adjustable length feature.

It is also an object of the present invention to provide a storage tank sump wherein the structure attaching the lid to the body of the storage tank sump is disposed outside of the sealing surfaces.

In accordance with one aspect of the present invention, there is provided an adjustable length storage tank sump having a body with an opening and outwardly extending formations disposed about the body. A seal is provided on the formation closest the opening and an attachment structure removably engages both this formation and a lid such that the lid sealingly contacts the seal. The formations are axially spaced so that a predetermined number of formations can be selectively separated from the body, thereby reducing the length of the body.

Each of the formations has a sealing surface disposed thereon for contacting the seal. Thus, each seal is interchangeable among the formations. In this manner, a simple single seal accommodating the length adjustability of the present invention is provided. In a preferred arrangement, each of the formations is in the form of a rib having a side wall which interconnects the sealing surface with a clamping surface disposed opposite the sealing surface. The attachment structure preferably includes a plurality of clamps having a substantially C-shaped cross section. Even more preferably, the clamps removably engage the rib closest to the opening and have an upwardly extending threaded fastener which engages the lid such that the lid sealingly engages the seal.

BRIEF DESCRIPTION OF THE DRAWINGS

While the specification concludes with claims particularly pointing out and distinctly claiming the invention, it is believed the same will be better understood from the following description taken in conjunction with the accompanying drawings in which:

DETAILED DESCRIPTION OF THE PREFERRED EMBODIMENTS

Figure 1:
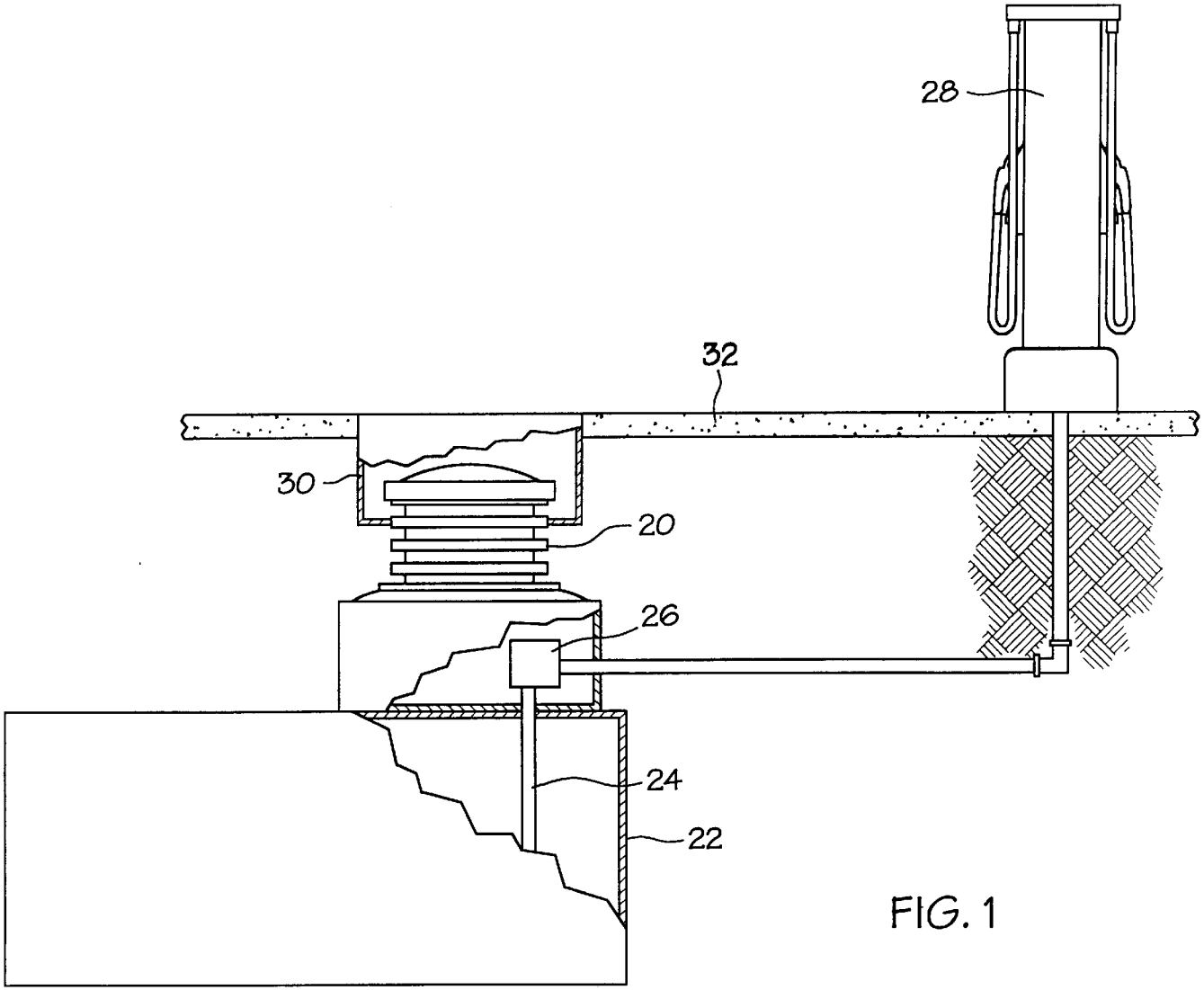
FIG. 1 is schematic side view of a storage tank installation incorporating a storage tank sump made in accordance with the present invention.

Referring now to the drawings in detail wherein like numerals indicate the same elements throughout the views, FIG. 1 illustrates the details of a preferred embodiment of an adjustable length storage tank sump 20 made in accordance with the present invention. The storage tank sump 20 is attached to a storage tank 22 and encloses a riser pipe 24 which extends upwardly from the storage tank 22. The storage tank sump 20 typically also encloses a liquid fuel pump, valves, filters, or other liquid transfer components 26 which are in fluid communication with the riser pipe 24 of the storage tank 22 such that the liquid residing in the storage tank can be transferred to above ground dispensers 28, such as automobile gasoline pumps and like. The storage tank sump 20 advantageously collects and contains any liquid spillage which occurs during the filling of the storage tank 22 or during servicing of the liquid transfer components 26 enclosed within the storage tank sump 20. The storage tank sump 20 is typically covered by a manhole 30 which is disposed substantially flush with a driveway slab 32, thereby permitting access to the storage tank sump 20 from above the ground.

The storage tank sump 20 can be formed from structural steels, aluminum, fiberglass and the like. More preferably, the storage tank sump 20 is formed from a high or medium density polyethylene or other similar resin, as is known in the art. A storage tank sump 20 formed from such a resin can be quickly and easily cut at the excavation site by hand-held tools, such as a saber saw, while still providing the necessary structural strength and rigidity. Typically, the storage tank sump 20 can be attached to the storage tank 22 by bolts or other fastening means as is known in the art.

Figure 2:
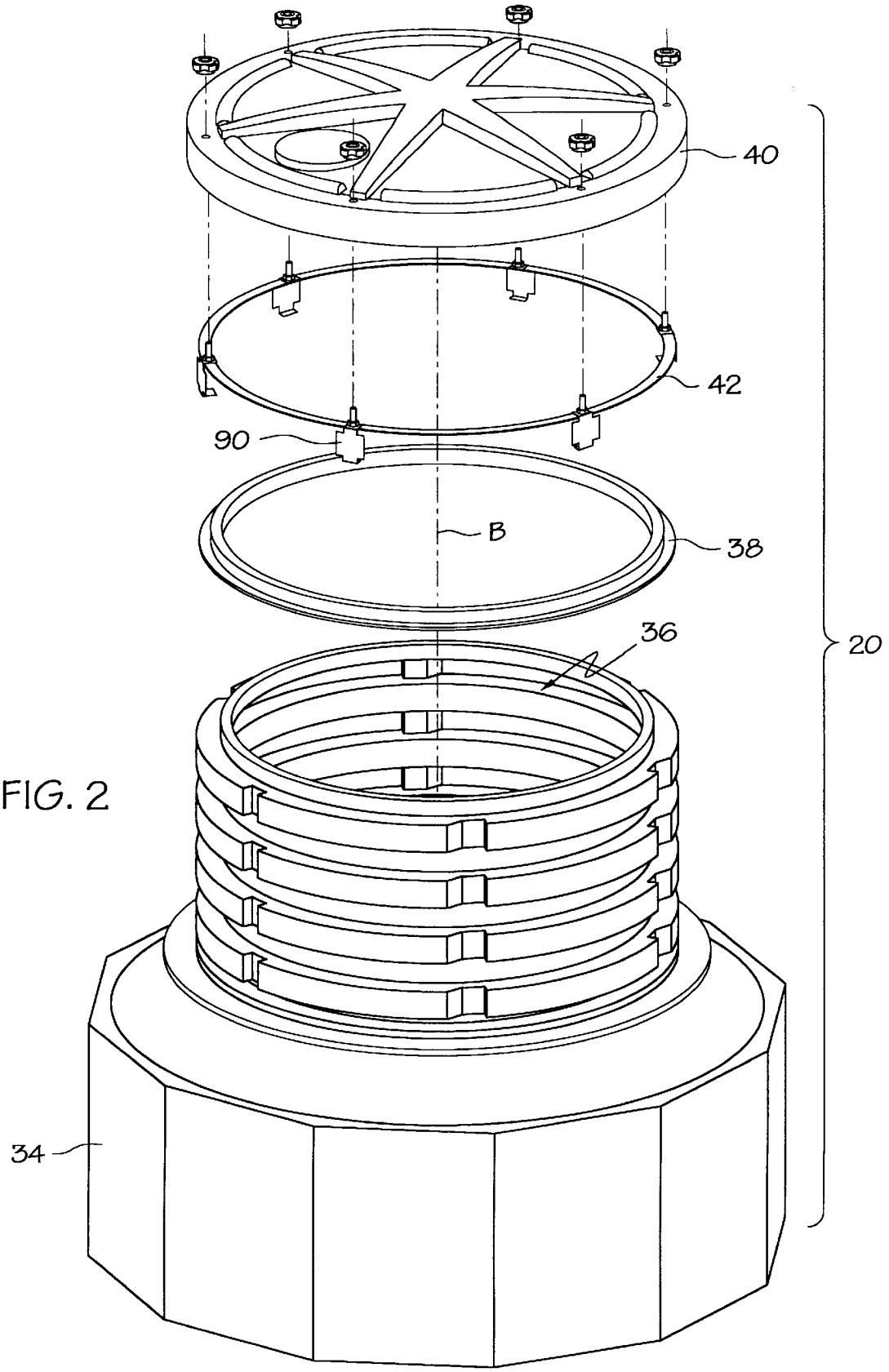
FIG. 2 is an exploded view of a preferred embodiment of a storage tank sump made in accordance with the present invention.
Figure 3:
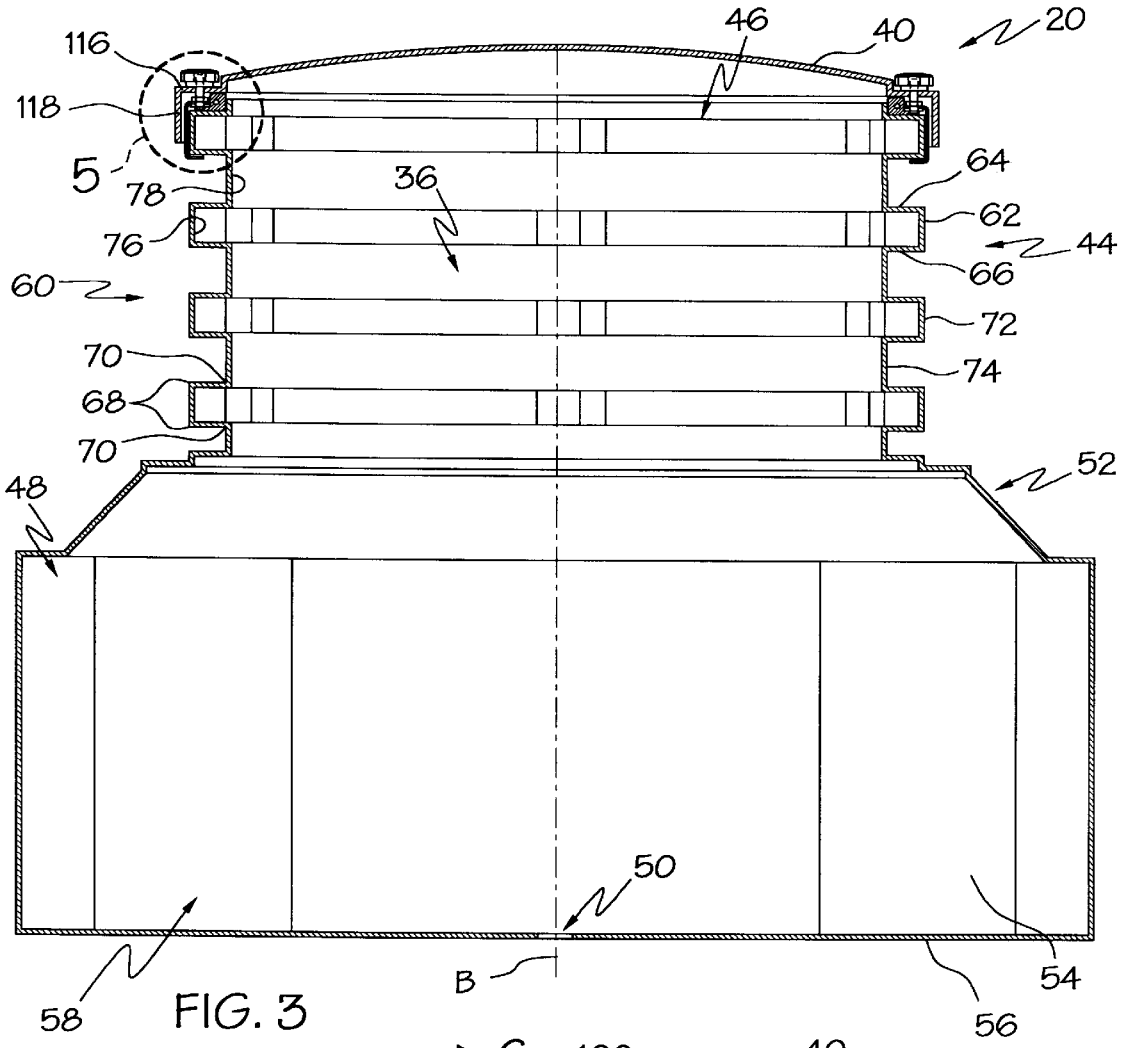
FIG. 3 is a cross-sectional side view of the storage tank sump of FIG. 2.

Referring now to FIG. 2, a preferred embodiment of a storage tank sump 20 of the present invention comprises a body 34 having a longitudinal axis B and a passage 36 substantially coaxial with the longitudinal axis B, a seal 38 disposed on the body 34, and a removable lid 40 which is joined to the body 34 by an attachment structure 42. As most clearly seen in FIG. 3, the body 34 preferably has an upper portion 44 with an opening 46 in communication with a passage 36 and a lower portion 48 with a riser pipe opening 50 through which the riser pipe 24 extends. A generally frusto-conical middle portion 52 is disposed between and in communication with the upper portion 44 and the lower portion 48. Preferably, the upper portion 44, middle portion 52, and lower portion 48 are substantially coaxially aligned with the body longitudinal axis B, as shown in FIG. 3.

The lower portion 48 is preferably polyhedral in shape and is formed from a plurality of interconnecting flat faces 54 which are joined to one another and to a substantially planar bottom wall 56, the arrangement and interconnection between the flat faces 54 and the bottom wall 56 defining a chamber 58. The chamber 58 has a sufficient volume to accommodate a variety of fluid transfer components, such as pumps, valves, filters, and the like which are arranged in fluid communication with the riser pipe 24. While it is preferred that the lower portion is formed from the plurality of flat faces 54 of between about 10 and about 14 in number for structural rigidity, it is contemplated that other polyhedral arrangements, such as cubic, can be equally suitable. Alternatively, the lower portion 48 can be formed in a substantially cylindrical shape. In addition to the riser pipe opening 50 which is disposed in the bottom wall 56, additional openings can be provided in either the bottom wall 56 or in one or more of the flat faces 54. For example, additional openings can be provided in the flat faces 54 to accommodate fluid lines extending from and/or returning to a fluid pump housed within the storage tank sump 20.

The generally frusto-conical middle portion 44 interconnects and is in communication with both the chamber 58 of the lower portion 48 and the passage 36 of the upper portion 44. While it is desirable to provide the middle portion 52 so as to provide a transition from the lower portion 48 having a polyhedral shape to the generally cylindrical upper portion 44, it is also contemplated that the upper portion 44 could be joined directly or otherwise coextensive with the lower portion 48, if, for example, the lower portion 48 were substantially cylindrical in shape, thereby dispensing with the need for a middle portion 52.

Figure 4:
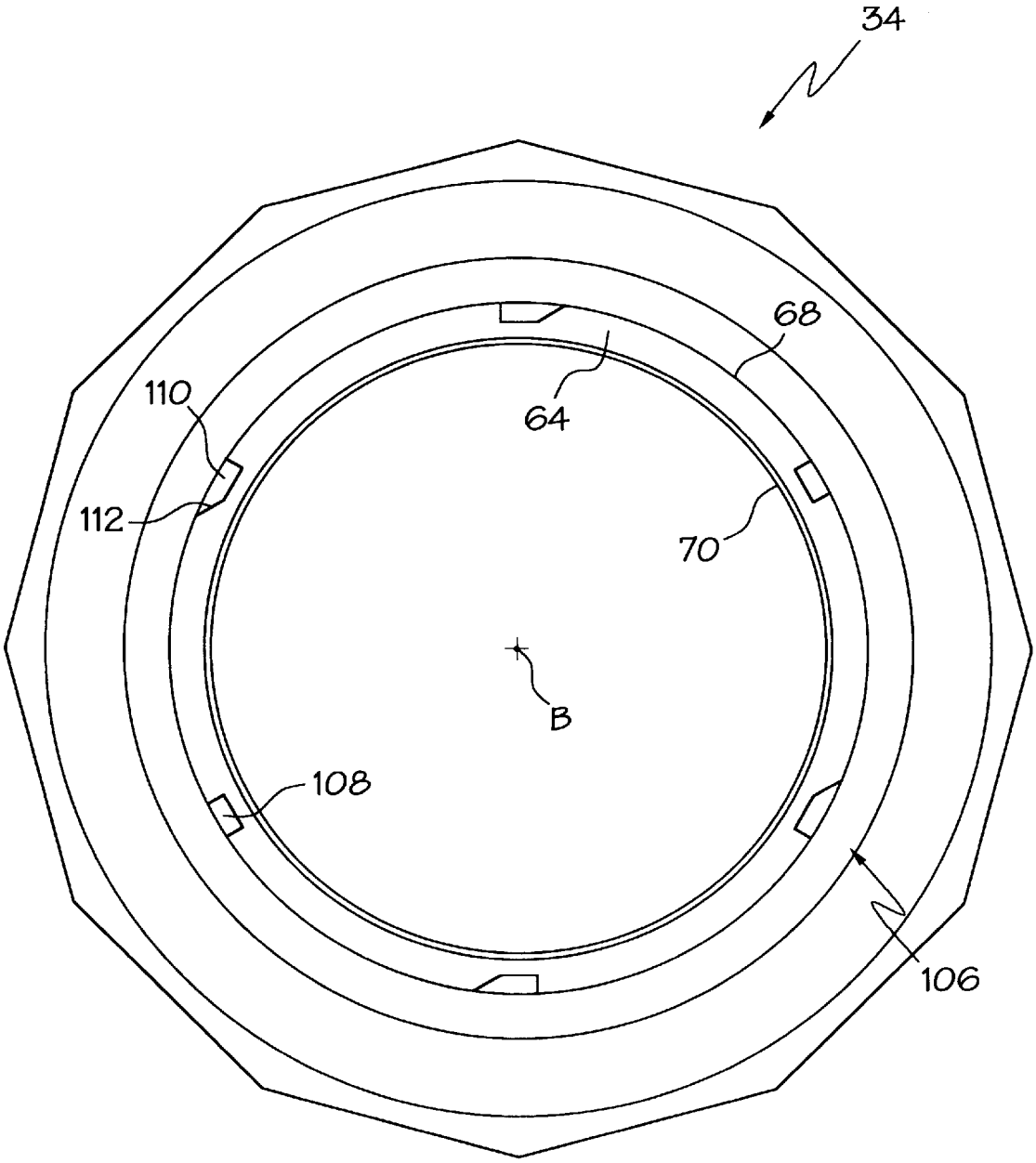
FIG. 4 is a top view of the body of the storage tank sump of FIG. 2.

The upper portion 44 preferably has a plurality of axially spaced formations 60. The formations 60 are spaced such that a predetermined number of them can be selectively separated from the body 34, thereby reducing the length of the body 34. In one preferred embodiment, the formations 60 comprise outwardly extending ribs 62, each rib 62 having a rib upper wall 64 and a rib lower wall 66 disposed opposite the rib upper wall 64. Both the rib upper walls 64 and the rib lower walls 66 are each preferably in the shape of a planar annular ring having an outer edge 68 and an inner edge 70, as best seen in FIG. 4.

Figure 5:
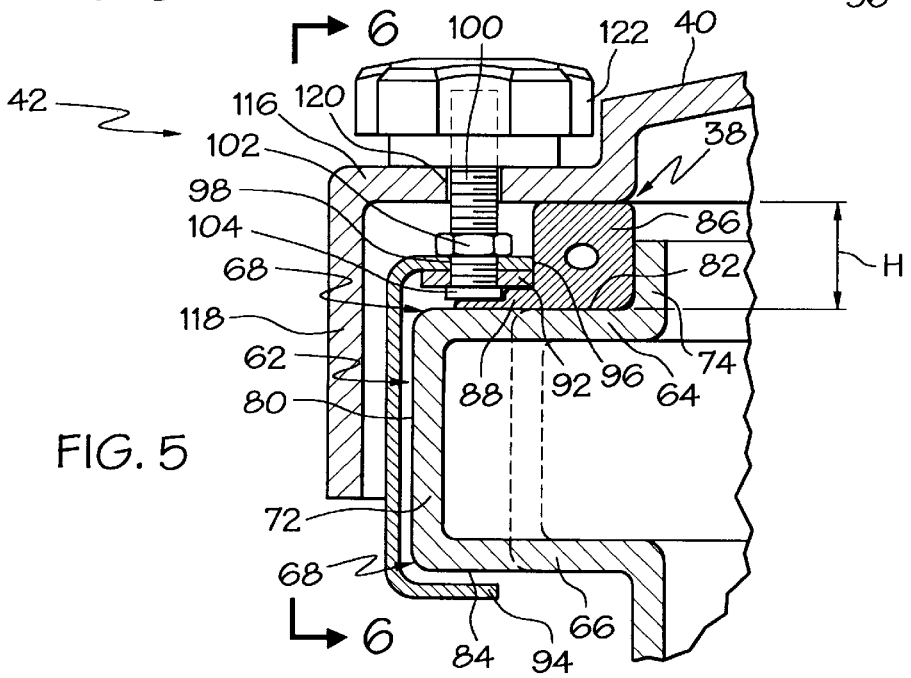
FIG. 5 is a partial cross-sectional side view of a rib of the storage tank sump of FIG. 4.

Referring now to FIGS. 3 and 5, the outer edge 68 of each rib upper wall 64 is joined to the outer edge 68 of its adjacent rib lower wall 66 by a generally cylindrical side wall 72. Similarly, a generally cylindrical rib spacing wall 74 joins adjacent ribs 62, interconnecting the inner edge 70 of a rib upper wall 64 to the inner edge 70 of a rib lower wall 66 of an adjacent rib 62.

Rib inner surfaces 76, which are defined by the combination of the upper, lower, and side walls, together with the spacing wall inner surfaces 78 define the passage 36 which extends the axial length of the upper portion 44. The inside diameter of the spacing wall inner surface 78 is preferably of sufficient size to provide access to the chamber 58 for the removal, installation, or servicing of the fluid transfer components disposed therein. As most clearly seen in FIG. 5, the outside diameter of the rib side wall outer surface 80, which also defines the location of the outer edge 68 of the rib upper and lower walls 64 and 66, respectively, is sufficient to provide an adequate sealing surface 82 on the rib upper wall 64 and an adequate clamp surface 84 on the rib lower wall 66. As used herein, the phrase "sealing surface" is intended to mean a surface which is in contact with the seal 38, or would be in contact with the seal 38 if the surface were adjacent the opening 46. For example, in the preferred arrangement illustrated in FIG. 5, the rib upper wall 64 and the spacing wall 74 both have a sealing surface in contact with the seal 38. Similarly, the phrase "clamp surface" is intended to mean a surface which is in surface contact with the attachment structure 42, or would be in contact with the attachment structure 42 if the surface were adjacent the opening 46.

While it is preferred that each of the formations 60 are in the form of a rib, it is contemplated that other formations can be equally suitable. For example, the formations 60 can comprise solid outwardly extending flanges, wherein each flange has a sealing surface as previously described. Alternatively, the formations can comprise a combination of a solid flange and a rib.

While it is contemplated that the axial spacing of the formations 60 in a direction along the longitudinal body axis B can vary depending upon the specific geometry of the formations 60, it is preferred that formations in the form of the ribs 62 have an axial spacing of about 0.25 formations per inch. In other words, a preferred embodiment of the present invention has one rib 62 disposed about the upper portion 44 of the body 34 about every four inches along the direction of the longitudinal body axis B. More preferably, the axial length for each of the spacing walls 74 and each of the rib side wall 72 in a direction along the longitudinal body axis B is about 2 inches.

An elastomeric seal 38 having a seal main body 86 which is generally rectangular in cross section and a seal extension 88 outwardly extending therefrom is provided on the rib 62 closest to the opening 46, as shown in FIG. 5. The seal 38 is disposed on the body 34 such that it is in surface contact with both the sealing surface 82 of the rib 62 closest to the opening 46 as well as the spacing wall 74 adjacent the opening 46, thereby maximizing the sealing effectiveness of the seal 38 by providing the most surface contact between the seal 38 and the body 34, as shown in FIG. 5. The seal 38 has a height H when sealingly compressed by the lid 40 such that the seal extends axially beyond the edge of the spacing wall 74 which is closest to the opening 46. This arrangement ensures that the lid 40 fully engages the seal 38 when it is installed rather than the lid 40 engaging the spacing wall 74 closest the opening 46, the later arrangement rendering the seal 38 ineffective. The seal 38 can be formed from elastomers such as buna nitrile (a German rubber substitute prepared by the polymerization of butadiene), polychloroprene, silicone rubber, and the like.

An attachment structure 42 is provided for removably engaging the formation 56 which is closest to the opening 46. In one preferred embodiment and as most clearly shown in FIG. 2, the attachment structure 42 comprises a plurality of clamps 90, each of which have a substantially C-shaped cross section for engaging formations 60 preferably in the form of the ribs 62. Each of the clamps 90 are preferably joined to and equally spaced about an annular ring 92. The ring 92 is sized so that it can be disposed radially outside of the spacing wall 74 while still engaging the rib 62 closest the opening 46, as most clearly seen in FIG. 5.

Each clamp 90 preferably has an engagement lip 94 and a fastener lip 96 disposed opposite the engagement lip 94, the lips forming the ends of the C-shaped cross section of the clamps 90. A fastener hole 98 is provided in the fastener lip 96 so that a threaded fastener 100 can pass therethrough. The threaded fastener 100 is anchored to each clamp 90 by the combination of an internally threaded nut 102 and a fastener anchor 104. The fastener anchor 104 has an outside diameter which is larger than the inside diameter of the fastener hole 98 such that the fastener anchor 104 cannot pass therethrough, but, rather, the nut 102 must first be disengaged from the threaded fastener 100 before the fastener 100 can be removed from the fastener hole 98. The engagement lip 94 extends radially inward and is sized to engage the clamp surface 84 of the rib 62 which is closest the opening 46 when the attachment structure 42 is removably connected to the body 34, as described more fully hereafter.

While it is preferred that the attachment structure 42 comprise between about 4 and about 8, and most preferably about 6, of the clamps 90, it is contemplated that a greater or less number of the clamps 90 can be provided. Generally, a more even sealing engagement between the lid 40 and the seal 38 is provided as the number of clamps 90 is increased. The above-described arrangement of the attachment structure 42 also advantageously provides an attachment structure which is disposed outside of the sealing surfaces of the present invention. In other words, the attachment structure 42 is disposed such that it does not interact with the interface between the seal 38 and sealing surfaces of the body 34. As such, the attachment structures of the present invention do not require their own seals and a simple single seal 38 is all that is required to seal the opening 46 and the passage 36.

As best seen in FIGS. 4 and 6, each rib side wall 72 has disposed therein a plurality of equally spaced slots 106 extending inwardly toward the longitudinal axis B of the body 34 and which are sized to slidably receive the engagement lip 94 of the clamps 90. The number of slots 106 corresponds to the number of the clamps 90 so that each clamp 90 has a corresponding slot 106. While the slots 106 can be provided in various configurations, it is preferred that rectangular slots 108 having a generally rectangular profile are provided in combination with slanted slots 110 having one or more slanted surfaces 112, wherein the slanted surface 112 is preferably outwardly extending, as shown in FIG. 4. In a more preferred arrangement, a pair of rectangularly shaped slots 108 and two pairs of slanted slots 110 are provided, wherein the slots 106 of each pair are disposed opposite one another (i.e., about 180 degrees apart). More preferably, the pair of rectangular slots 108 are disposed such that the slanted surface 112 of the slanted slots 110 are disposed on either side of each rectangular slot 108, as shown in FIG. 4.

Referring now to FIG. 6, each clamp 90 preferably further comprises a pair of oppositely opposed extensions 114 which function to align the clamp 90 so that the attachment structure 42 can easily slidably translate downwardly through the slots 106 and about the rib side wall outer surface 80, as discussed more fully hereafter. Particularly, the extensions 114 extend outwardly away from the clamp 90 so that the extensions 114 can engage the rib side wall outer surface 80 as the clamp 90 slidably translates within the slot 106. In this manner, each clamp 90 is never fully disposed within the slot 114 such that rotation of the attachment structure 42 about the longitudinal axis B would be prevented when the engagement lips 94 are disposed below the rib lower wall 66.

Referring back now to FIG. 3, a generally circular removable lid 40 is provided for sealing and covering the opening 46. The lid 40 preferably has a substantially planar member 116 and a cylindrical downwardly depending flange 118 extending therefrom. The substantially planar member 116 engages the seal 38 when the lid 40 is removably attached to the body 34 by the attachment structure 42, as most clearly seen in FIG. 5. A plurality of lid bores 120 extend through the planar member 116 and are spaced so that each of the threaded fasteners 100 of the clamps 90 can pass therethrough. The planar member 116 is of sufficient width to accommodate a lid nut 122, the lid nut 122 threadably engaging the threaded fastener 100 when the lid 40 is installed on the body 34. The downwardly depending flange 118 adds structural rigidity to the lid 40 and also protects the seal 38 from abrasive contaminants which might otherwise damage the seal 38 during installation of the storage tank 22 in the excavation hole.

In operation, the length adjustment and installation of a preferred embodiment of the storage tank sump 20 of the present invention is first accomplished by selectively removing a predetermined number of the formations 60 and the spacing walls 74 from the body 34 so that the storage tank sump 20 can be situated at the optimal height with respect to the placement of the manhole 30. Particularly, the length adjustability of the storage tank sump 20 can accommodate variations in the installed height of the storage tank 22 while still ensuring that the manhole 30 can be properly placed with respect to the storage tank sump 20. Once the number of the formations 60 and spacing walls 74 for reducing the length of the storage tank sump 20 is determined, a portable cutting tool can be used to cut a spacing wall 74 such that the predetermined number of formations 60 and the spacing walls 74 axially above the location of the cut can be removed. Because each formation 60 has a sealing surface 82, the seal 38 can be installed on whichever formation 60 is closest the opening 46 after removal of the predetermined number of formations 60 and spacing walls 74.

Figure 6A:
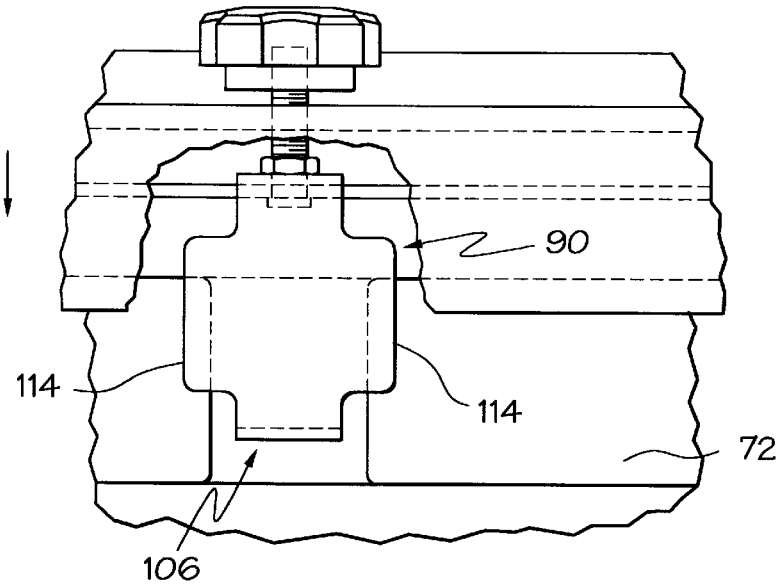
FIG. 6 is a partial side view of the rib of FIG. 5, wherein the clamp is shown in various stages of installation.
Figure 6B:
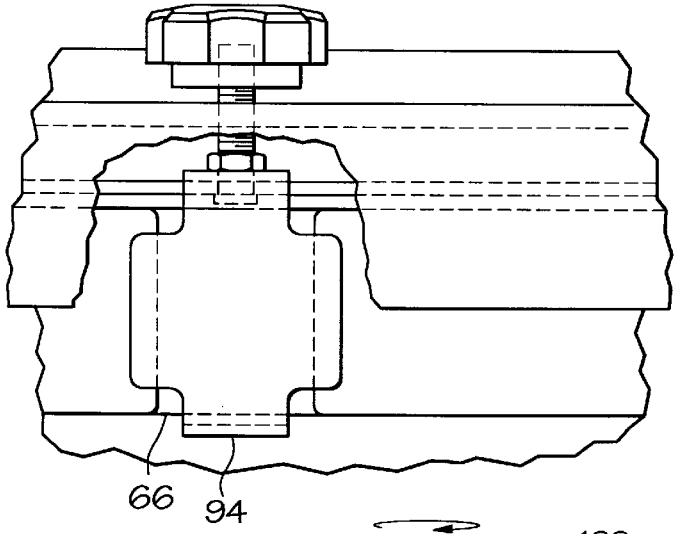
Figure 6C:
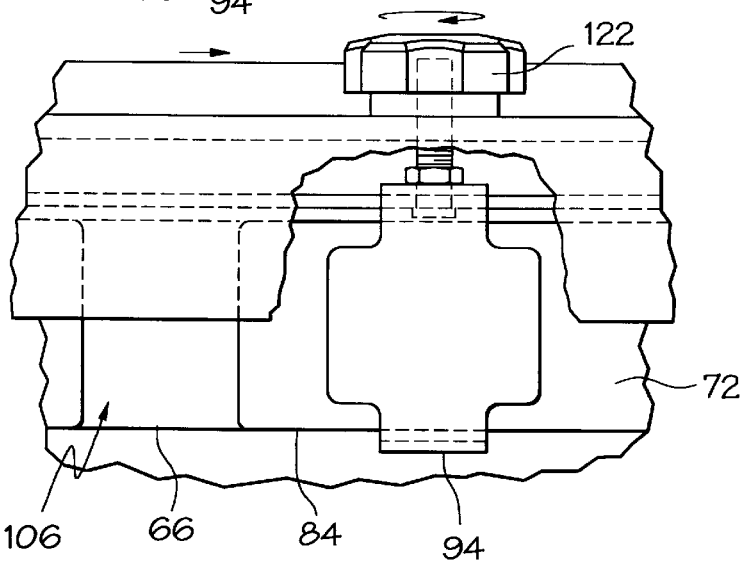

Following removal of the predetermined number of the formations 60, the seal 38 is installed on the sealing surface 82 of the formation 60 closest to the opening 46. If the formations are in the form of the ribs 62 and the attachment structure 42 comprises the clamps 90, the attachment structure 42 can be joined to the removable lid 40 by inserting the threaded fasteners 100 attached to the ring 92 through the lid bore holes 120 and threadably attaching the lid nuts 122 thereto. The combination of the removable lid 40 and the attachment structure 42 is installed on the body 34 of the storage tank sump 20 by aligning the engagement lip 94 of each clamp 90 with its corresponding slot 106 on the rib 78 closest to the opening 46. As illustrated in FIG. 6*a*, the combination of the lid 40 and the attachment structure 42 is then slidably translated axially downwardly such that the engagement lip 94 passes through the slot 106. Once the engagement lips 94 are translated through the slots 106 such that each engagement lip 94 is disposed below the rib lower wall 66, as best shown in FIG. 6*b*, the combination of the lid 40 and the attachment structure 42 are rotated about the longitudinal axis B such that each engagement lip 94 is juxtaposed adjacent the clamping surface 84 of the rib 62 closest to the opening 46. Once the combination of the lid 40 and the attachment structure 42 is in the above-described position, the lid nuts 122 are tightened, as shown in FIG. 6*c*, thereby drawing the engagement lip 94 into contact with the clamp surface 84 and the lid 40 into sealing contact with the seal 38.

As an alternative to the above-described installation process, the attachment structure 42 can be first attached to the body 34 of the storage tank sump 20 in a similar manner as previously described. In other words, the combination of the ring 92 and the clamps 90 is aligned so that the engagement lips 94 are disposed axially above the slots 106. The attachment structure 42 is then translated axially downward and rotated as described above. The lid 40 is then attached to the attachment structure 42 by inserting the threaded fasteners 100 through the lid holes 120 so that the lid nuts 122 can be threadably attached to the threaded fasteners 100. The lid nuts 122 are then tightened as previously discussed, thereby drawing the engagement lip 94 into contact with the clamp surface 84 and the lid 40 into sealing contact with the seal 38.

The lid 40 can be removed by loosening and removing the lid nuts 122 so that the lid 40 can be translated axially upward away from the body 34, thereby exposing the opening 46. Preferably, the seal 38 is provided with the seal extension 88 such that the clamps 90 can engage the same when the attachment structure 42 is installed. This arrangement prevents the seal 38 from lifting away from the body 34 when the lid 40 is removed. Alternatively, the lid 40 can be removed by loosening but not removing the lid nuts 122 and thereafter rotating the combination of the lid 40 and the attachment structure 42 until the engagement lips 94 are aligned with the slots 106. The combination of the lid 40 and the attachment structure 42 can then be translated axially upward and away from the body 34, thereby exposing the opening 46. Removal of the combination of the lid 40 and the attachment structure 42 would expose the seal 38 such that the seal 38 can be easily removed from the formation 60 closest to the opening 46 and quickly replaced.

Having shown and described the preferred embodiments of the present invention, further adaptations of the storage tank sump described herein can be accomplished by appropriate modification by one of ordinary skill in the art without departing from the scope of the present invention. Several of such potential modifications have been mentioned, and others will be apparent to those skilled in the art. Accordingly, the scope of the present invention should be considered in terms of the following claims and is understood not to be limited to the details of structure and operation shown and described in the specification and drawings.

What is claimed is:

1. A length adjustable storage tank sump, comprising:

a body having an opening and a plurality of outwardly extending formations, each of said formations having a sealing surface, said formations being axially spaced from one another so that one or more of said formations can be selectively separated from said body thereby reducing the length of said body;

a seal for engaging said sealing surface of said formation closest to said opening;

a removable lid for covering said opening and engaging said seal; and an integral attachment structure which is separable from said body during use having a plurality of fastening members for engaging said formation closest to said opening and for engaging said lid to compress said seal about substantially all of the periphery of said opening, said attachment structure being interchangeable among at least some of said formations so that said attachment structure can engage said formation closest to said opening after said selective separation of at least one formation from said body.

2. The storage tank sump of claim 1, wherein said seal has a radial extension and wherein said integral attachment structure engages a portion of said radial extension during use.

3. The storage tank sump of claim 1, wherein said body comprises a unitary structure.

4. The storage tank sump of claim 1, wherein said lid is adapted to be removed from said body without removing said attachment structure therefrom.

5. The storage tank sump of claim 1, wherein said lid is adapted to be removed from said body without removing said seal therefrom.

6. A storage tank sump of claim 1, wherein each of said formations has an upper wall and a lower wall disposed opposite said upper wall and said attachment structure is adapted to engage said lower wall of said formation closest to said opening during use.

7. The storage tank sump of claim 1, wherein said formation closest to said opening has an upper wall and a lower wall, said attachment structure compressingly contacting said upper and lower walls during use.

8. The storage tank sump of claim 1, wherein said formation closest to said opening is devoid of a hole therein for engaging said attachment structure.

9. The storage tank sump of claim 1, further comprising a ring, wherein each of said fastening members is joined to said ring.

10. The storage tank sump of claim 1, wherein a portion of said fastening members is disposed in between said lid and said formation closest to said opening.

11. The storage tank sump of claim 10, wherein said lid has a downwardly depending flange and wherein said portion of said fastening members is disposed radially inward from said flange.

12. The storage tank sump of claim 11, wherein said portion of said fastening members is disposed between said downwardly depending flange and said opening of said body.

13. A method for using a vertically adjustable storage tank sump, comprising the steps of:

providing a storage tank sump comprising an opening, a plurality of outwardly extending formations which are axially spaced from one another, each of said formations having a sealing surface, a seal located on said sealing surface of said formation closest to said opening, a removable lid for covering said opening, an integral attachment structure having a plurality of fastening members, said attachment structure being interchangeable among said formations;

removing one or more of said formations, thereby reducing the height of said body;

removably attaching said attachment structure to said formation closest to said opening;

attaching said lid to said body using said attachment structure; and sealing said opening by compressing said seal about substantially all of the periphery of said opening with said integral attachment structure.

14. The method of claim 13, wherein each of said members is provided in the form of a rib, each of said ribs having a clamping surface opposite said sealing surface, said sealing surface and said clamping surface being interconnected by a side wall.

15. The storage tank sump of claim 13, further comprising the step of detaching said lid from said body without removing said attachment structure therefrom.

16. A storage tank sump, comprising:

a body having an opening and a plurality of outwardly extending formations, each of said formations having a sealing surface, said formations being axially spaced from one another so that one or more of said formations can be selectively separated from said body thereby reducing the length of said body;

a seal for engaging said sealing surface of said formation closest to said opening;

a removable lid for covering said opening and engaging said seal; and an integral attachment structure having a plurality of fastening members for engaging said formation closest to said opening and for engaging said lid, at least a portion of said fastening members extending through said lid; and wherein said integral attachment structure is substantially rotable about the longitudinal axis of said body when said portion of said fastening members extends through said lid.

17. The storage tank sump of claim 16, wherein each of said fastening members have a threaded portion attached thereto and wherein said threaded portion extends through said apertures.

18. The storage tank sump of claim 17, wherein said fastening members are clamps and each of said clamps has a lip for engaging a clamp surface of said formation closest to said opening.

19. The storage tank sump of claim 16, wherein said lid comprises a plurality of apertures for receiving said portion of said fastening members and wherein said lid has a sealing surface for engaging said seal, said apertures being disposed radially outward from said sealing surface of said lid.

20. A length adjustable storage tank sump, comprising:

a body having an opening and a plurality of outwardly extending formations, each of said formations having a sealing surface and a plurality of slots extending inwardly toward the longitudinal axis of said body, said formations being axially spaced from one another so that one or more of said formations can be selectively separated from said body thereby reducing the length of said body;

a seal for engaging said sealing surface of said formation closest to said opening;

a removable lid for covering said opening and engaging said seal; and an integral attachment structure having a plurality of fastening members for engaging said formation closest to said opening and for engaging said lid to compress said seal about substantially all of the periphery of said opening, said slots being sized to slidably receive at least a portion of said fastening members.

21. An underground length adjustable storage tank sump for use with a manhole, comprising:

a body having an opening and a plurality of outwardly extending formations, each of said formations having a sealing surface, said formations being axially spaced from one another so that one or more of said formations can be selectively separated from said body thereby reducing the length of said body;

a seal engaging said sealing surface of said formation closest to said opening;

a removable lid covering said opening and engaging said seal; and an integral attachment structure having a plurality of fastening members engaging said formation closest to said opening and engaging said lid to compress said seal about substantially all of the periphery of said opening, said integral attachment structure being removeable from the sump through the manhole during use when the sides of the manhole are disposed adjacent to said body.

22. The storage tank sump of claim 17, further comprising a nut for engaging said threaded portion.

* * * * *

UNITED STATES PATENT AND TRADEMARK OFFICE

CERTIFICATE OF CORRECTION

PATENT NO. : 5,950,860
DATED : September 14, 1999
INVENTOR(S) : James Kesterman et al It is certified that error appears in the above-identified patent and that said Letters Patent is hereby corrected as shown below:

Column 9, claim 15, line 1, change "storage tank sump" to --method--.

Column 9, claim 16, line 22, change "rotable" to --rotatable--.

Signed and Sealed this

Fourteenth Day of March, 2000

*Attest:*

Q. TODD DICKINSON

*Attesting Officer*

*Commissioner of Patents and Trademarks*